US007127746B2

(12) United States Patent
Park

(10) Patent No.: US 7,127,746 B2
(45) Date of Patent: Oct. 31, 2006

(54) PRESSURE RESOLVING CAP AND HEADBAND THEREOF

(75) Inventor: Boo Yl Park, Seoul (KR)

(73) Assignee: DADA Corp., Seoul (KR)

( * ) Notice: Subject to any disclaimer, the term of this patent is extended or adjusted under 35 U.S.C. 154(b) by 266 days.

(21) Appl. No.: 10/337,374

(22) Filed: Jan. 7, 2003

(65) Prior Publication Data

US 2004/0128738 A1 Jul. 8, 2004

(51) Int. Cl.
*A42B 1/00* (2006.01)

(52) U.S. Cl. ..... 2/195.3; 2/195.1

(58) Field of Classification Search ..... 2/195.2, 2/181, 195.1, 195.3, 183, 175.1, 417, 418, 2/184

See application file for complete search history.

(56) References Cited

U.S. PATENT DOCUMENTS 3,027,564 A * 4/1962 Wagenfeld ..... 2/181
5,012,532 A 5/1991 Krystal
5,048,128 A 9/1991 Watson, Jr.
5,142,705 A 9/1992 Edwards
5,161,260 A 11/1992 Reynolds
5,272,772 A 12/1993 Hahn
5,426,789 A 6/1995 MacLeod
6,016,572 A 1/2000 Park
6,493,880 B1 * 12/2002 Lo ..... 2/195.2
2004/0019954 A1 * 2/2004 Park ..... 2/195.1

* cited by examiner

*Primary Examiner*—John J. Calvert
*Assistant Examiner*—Richale L. Haney
(74) *Attorney, Agent, or Firm*—Mayer, Brown, Rowe & Maw LLP

(57) ABSTRACT

Headwear having a crown and a headband attached to and extending around the lower inside edge of the crown. A visor part may also be attached to the underside of the crown. The headband is made of two sheets of elastic cloth excluding polyurethane yarn so as to provide good stretch without imposing undue elastic pressure on the wearer. The crown is made of several sheets of material, at least two of which are attached to each other by an elastic connecting portion for increased stretch and wearer comfort.

10 Claims, 4 Drawing Sheets

PRESSURE RESOLVING CAP AND HEADBAND THEREOF

BACKGROUND OF THE INVENTION

1. Field of the Invention

The present invention is related to the field of headwear and, more particularly, to a headband and headwear including the same for automatically fitting a range of head sizes while remaining comfortable for extended wear.

2. Description of the Related Art

A baseball style cap generally includes a crown main body, a visor portion secured to the forward edge of the crown and extending outwardly therefrom, a headband attached to the lower part of the inside of the crown, and a size controller attached to an underside of the rear of the cap. The size controller is used to adapt the size of the cap which can be inconvenient as multiple size adjustments may be necessary.

In view of this inconvenience, so-called "free size" caps have been constructed which do not include separate size controlling portions. Instead, size adjustability is obtained through the elasticity of various portions of the cap. For example, U.S. Pat. No. 6,016,572 discloses a baseball-style cap in which two or more sheets of cloth among those used to make the crown portion are connected to one another with elastic material and coupled with an elastic headband which can be expanded to accommodate various head sizes without the need for a size controller. It has been found, however, that such a cap exerts pressure against the wearer's head which can become uncomfortable after the cap is worn for an extended period of time.

Accordingly, a need exists for a free-size cap having a stretchable headband that can accommodate a wide range of head sizes without imposing undue pressure on the wearer so as to remain comfortable over extended time periods.

SUMMARY OF THE INVENTION

In view of the foregoing, one object of the present invention is to provide headwear with a headband that can stretch to accommodate different head sizes without a separate size controlling mechanism.

Another object of the present invention is to provide automatic size-adjusting headwear having a headband made of two sheets of elastic cloth without polyurethane yarn so as not to exert undue pressure on the head when worn.

A further object of the present invention is to provide a cap in which two or more cloths forming the crown portion are made of elastic textile and are connected to one another with elastic material of contrasting color.

Yet another object of the present invention is to provide a headband made of elastic cloth excluding polyurethane yarn.

In accordance with these and other objects, the present invention is directed to headwear having a crown portion and a headband attached to and extending around the lower inside edge of the crown portion. A visor part may also be attached to the underside of the crown portion. The headband is made of two sheets of elastic cloth excluding polyurethane yarn so as to provide good stretch without imposing undue elastic pressure on the wearer.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
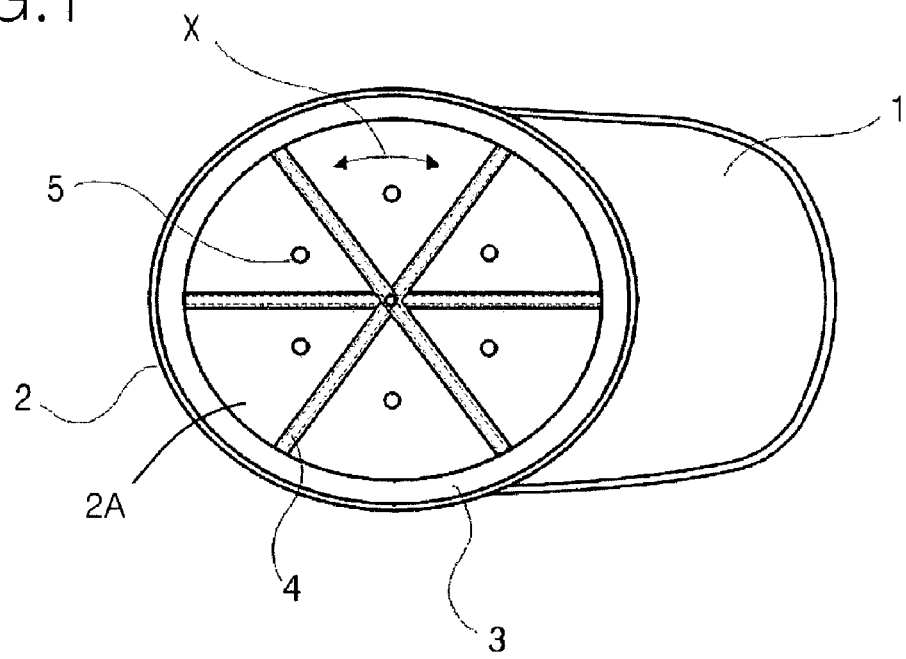
FIG. 1 is a bottom view of a pressure-resolving cap according to the present invention.

In describing preferred embodiments of the invention illustrated in the drawings, it is to be understood that these embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The present invention is directed to a pressure-resolving cap having a headband made of elastic cloth excluding polyurethane yarn. As shown in FIG. 1, the pressure-resolving cap with headband may be embodied as a baseball-style cap having a visor 1, crown 2, and headband 3. The visor is attached to the front side of the crown 2, and the headband 3 is attached to the inner edge of the underpart of the crown. The crown 2 is made of several fabric sheets or gores 2A, at least two of which are joined together by an elastic connecting portion 4. The gores 2A may further include eyelets 5 as is known in the art.

Figure 2:
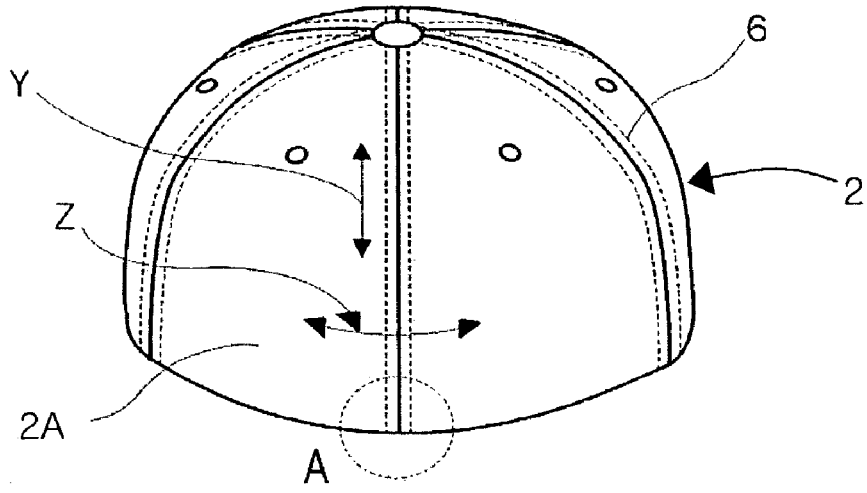
FIG. 2 is a rear view of the cap shown in FIG. 1.
Figure 2A:
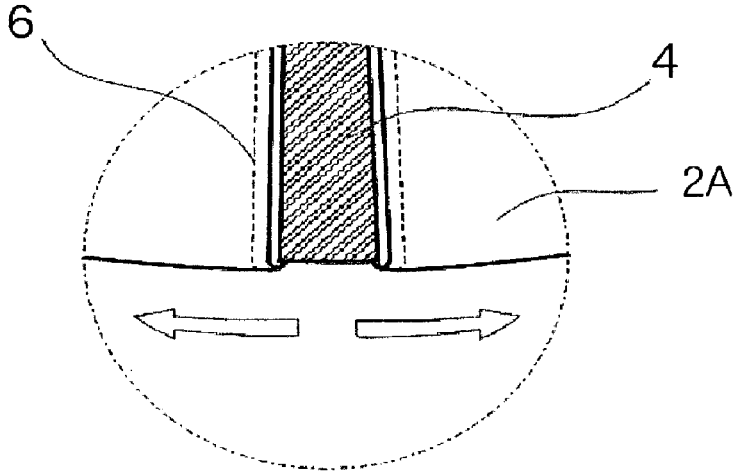
FIG. 2*a* is a magnified view of portion A of FIG. 2, shown with the elastic connecting portion in an expanded state.
Figure 3:
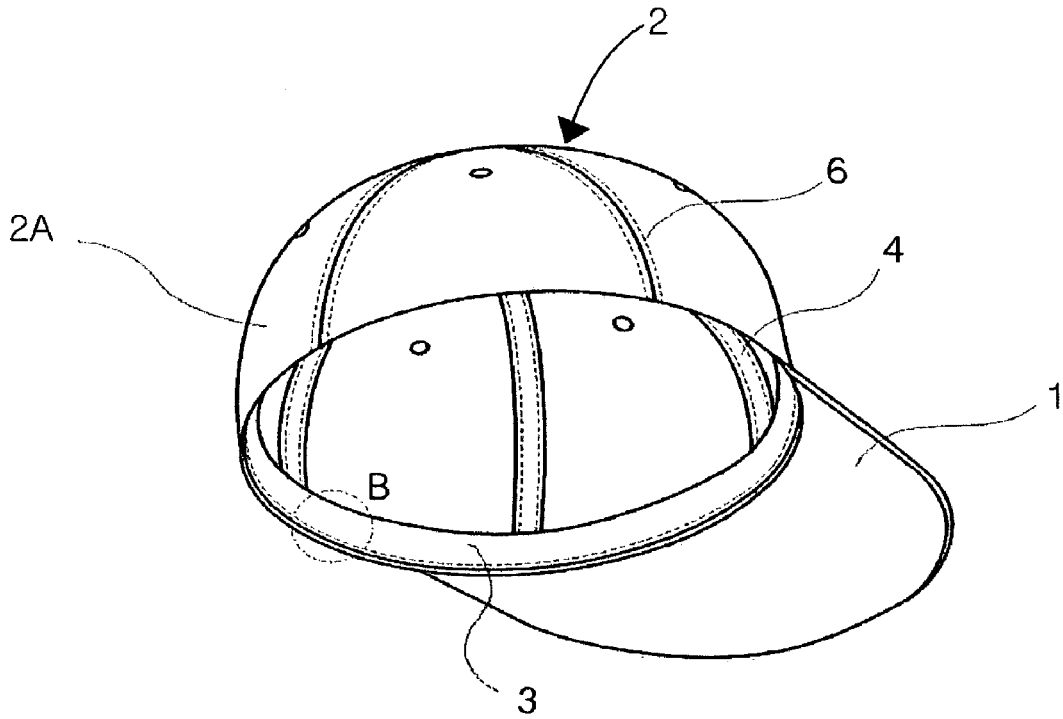
FIG. 3 is a perspective view of the cap shown in FIG. 1.

At least one of the gores 2A is preferably made of elastic textile so as to be expandable in X, Y and Z directions, as shown in FIGS. 1 and 2. The gores 2A are connected to the elastic connecting portion 4 along lines of stitching 6. As shown in FIGS. 2 and 3, the elastic connecting portion 4 joining the gores is visible on the inside surface of the crown and, when in a non-expanded state, is generally hidden from external view by the gores. When the elastic connecting portion 4 is in an expanded state, however, as shown in FIG. 2*a*, it is visible between the gores. Accordingly, through color contrasting of the elastic connecting portion 4 and the gore material, the aesthetic appeal of the cap may be enhanced.

Figure 3A:
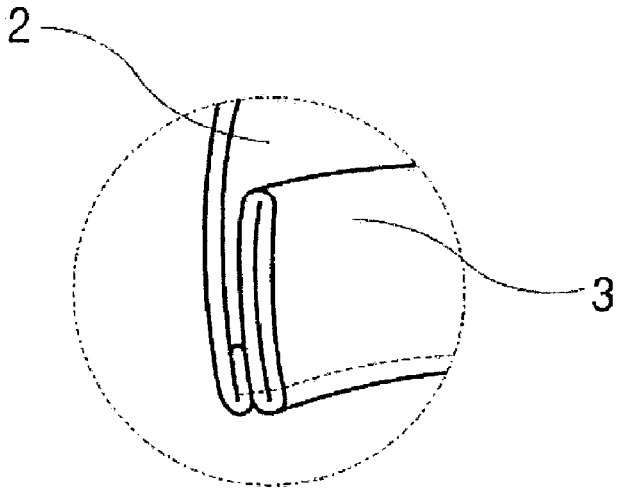
FIG. 3*a* is a cross-sectional view of portion B of FIG. 3.

As shown in FIG. 3*a*, the headband 3 has a tunnel shape and is attached to the inner edge of the underpart of the crown 2. The headband is preferably woven with two ply each ply is made by arranging 400 bundles in warp-way and 2 bundles in weft-way, each bundle being consisted of 48 high elastic yarns and each yarn being 170D, having no polyurethane. When measuring weight of a thread which is 9 km long, the thread is 1 Denier if the weight is 1 gram. Therefore, if the weight of the thread is 170 grams, it is 170D (Denier). Thus constructed, the headband 3 may be stretched 25%–45% under the weight of 1.8 Kg after 10 seconds, and demonstrates 0.4% to 3% of residual rate within 30 seconds following removal of the weight.

On wearing the cap, the headband naturally expands to accommodate the wearer's head, while also providing good ventilation due to the tunnel shaping of the band. Expansion of the cap is also aided by the elastic textile material of the gores 2A and the elastic connecting portion 4 joining at least two of the gores. Excessive pressure arising from the memory of the elastic is prevented by the two-ply construction constituting the headband as just described in the above paragraph.

Figure 4:
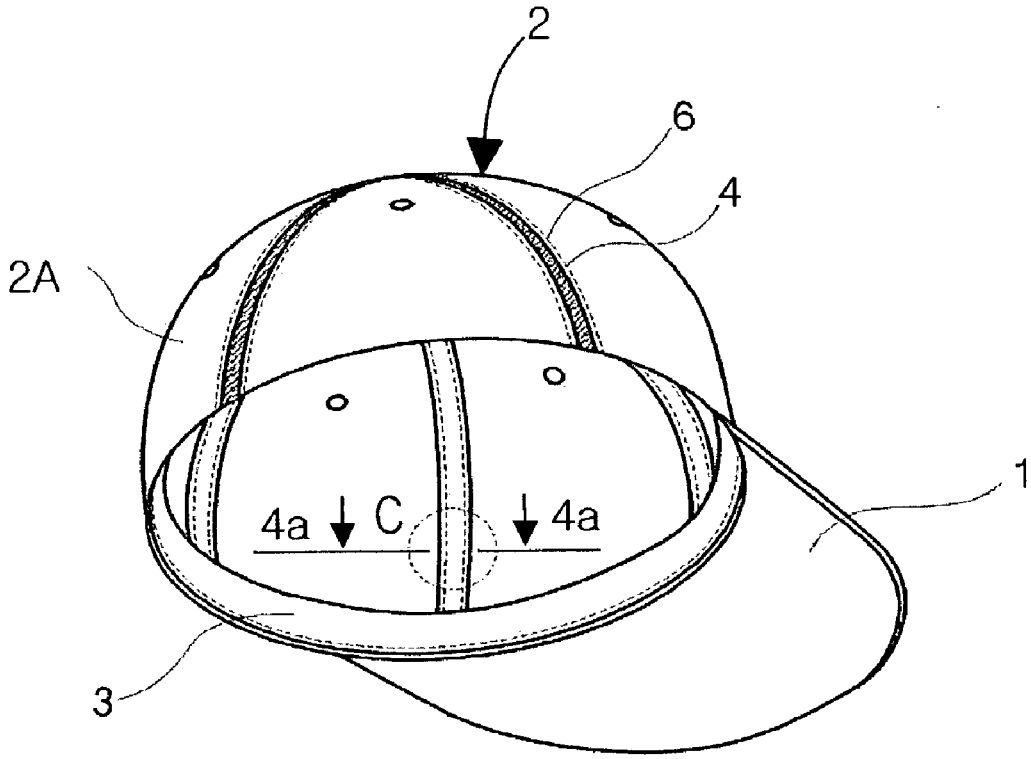
FIG. 4 is an bottom perspective view of the cap of FIG. 1, shown with the elastic connecting portions in the expanded state.
Figure 4A:
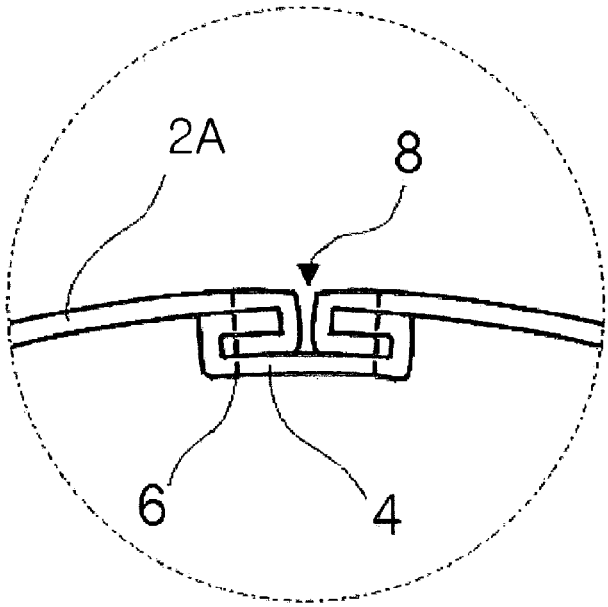
FIG. 4*a* is a cross-sectional view of portion C of FIG. 4, taken along line 4*a*—4*a;*

The expanded state of the elastic connecting portion 4 is illustrated in FIG. 4, demonstrating that when expanded the elastic connecting portion can be seen from both the inside and outside of the crown 2. Furthermore, while the elastic connecting portion 4 is generally hidden from external view when non-expanded, the gores may be spaced such that a gap 8 remains between them even when the elastic connecting portion is not stretched, as shown in FIG. 4*a*. With this spaced construction, the visual appeal of the cap is enhanced when the elastic connecting portion 4 has a contrasting color relative to the gores, creating a piped effect.

As also illustrated in FIG. 4*a*, the lines of stitching 6 connecting the gores and the connection portion 4 preferably pass through a double layer of the gore material and a double layer of the elastic connecting portion, folded back upon each other as shown.

Figure 5:
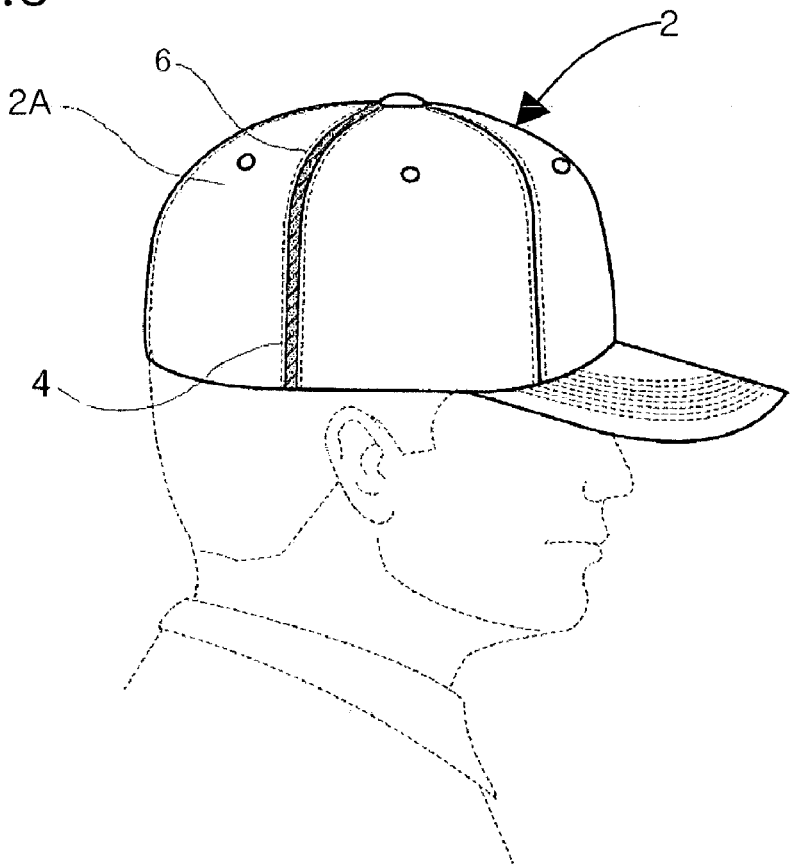
FIG. 5 is a side view of the pressure-resolving cap as worn in use, according to the present invention.

The pressure-resolving cap according to the present invention is shown in use in FIG. 5, with the elastic connecting portion 4 expanded and visible between the gores 2A of the crown 2.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the headband may be incorporated into hats, caps and visors of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. Headwear comprising:

a crown including a plurality of cloth sheets attached to one another; and a headband attached to a lower peripheral edge of said crown, said headband made of two sheets of cloth excluding polyurethane yarn, wherein said plurality of cloth sheets are attached to one another by elastic connecting portions and spaced such that said elastic connecting portions are visible on an outer surface of the crown whether expanded or unexpanded, wherein said headband is made by arranging 400 bundles in warp-way and 2 bundles in weft-way, each bundle being consisted of 48 high elastic yarns and each yarn being 170D.

2. The headwear as set forth in claim 1, wherein at least one of said plurality of cloth sheets of said crown is made of a biaxially stretchable elastic fabric.

3. The headwear as set forth in claim 1, wherein said headband stretches 25% to 45% under a weight of 1.8 Kg after 10 seconds, and demonstrates 0.4% to 3% of residual rate within 30 seconds of weight removal.

4. The headwear as set forth in claim 1, wherein said headband stretches 25% to 45% under a weight of 1.8 Kg after 10 seconds, and demonstrates 0.4% to 3% of residual rate within 30 seconds of weight removal.

5. Headwear comprising:

a crown including a plurality of cloth sheets, at least two of which are joined by an elastic connecting portion; and a headband attached to a lower peripheral edge of said crown, said headband made of two sheets of elastic cloth woven in two ply to have a tunnel shape and excluding polyurethane yarn, wherein said headband stretches 25% to 45% under a weight of 1.8 Kg after 10 seconds, and demonstrates 0.4% to 3% of residual rate within 30 seconds of weight removal, wherein said headband is made by arranging 400 bundles in warp-way and 2 bundles in weft-way, each bundle being consisted of 48 high elastic yarns and each yarn being 170D.

6. The headwear as set forth in claim 5, wherein said headband stretches 25% to 45% under a weight of 1.8 Kg after 10 seconds, and demonstrates 0.4% to 3% of residual rate within 30 seconds of weight removal.

7. The headwear as set forth in claim 6, wherein at least one of said plurality of cloth sheets of said crown is made of a biaxially stretchable elastic fabric.

8. The headwear as set forth in claim 5, wherein said elastic connecting portion is only visible on an outer surface of the crown when in an expanded state.

9. The headwear as set forth in claim 5, wherein said plurality of cloth sheets are spaced such that said elastic connecting portion is visible on an outer surface of the crown whether expanded or unexpanded.

10. A headband for a baseball-style cap made by arranging 400 bundles in warp-way and 2 bundles in weft-way, each bundle being consisted of 48 high elastic yarns and each yarn being 170D, said headband stretching 25% to 45% under a weight of 1.8 Kg after 10 seconds, demonstrating 0.4% to 3% of residual rate within 30 seconds of weight removal, and excluding polyurethane yarn.

* * * * *